United States Patent [19]

Sloan

[11] Patent Number: 5,064,233

[45] Date of Patent: Nov. 12, 1991

[54] DISPOSABLE COLLECTION DEVICE FOR ANIMAL LITTER

[76] Inventor: Donald G. Sloan, 17411 Chatsworth St., Ste. 100, Granada Hills, Calif. 91344

[21] Appl. No.: 504,533

[22] Filed: Apr. 4, 1990

[51] Int. Cl.[5] ..... A01K 29/00; E01H 1/12

[52] U.S. Cl. ..... 294/1.3; 15/257.7; 294/55; 294/131

[58] Field of Search ..... 294/1.3–1.5, 294/7, 49, 50, 55, 57, 131; 15/104.8, 257.1, 257.2, 257.7; 119/1, 161, 165, 168; 383/6, 12–14, 21, 25, 26; 16/114 R, 114 A, 115

[56] References Cited

U.S. PATENT DOCUMENTS

| | | | |
|---|---|---|---|
| 637,162 | 11/1899 | Rose | 15/257.7 |
| 1,160,748 | 11/1915 | Natale | 294/55 |
| 1,175,192 | 3/1916 | Tankersley | 294/131 |
| 1,201,076 | 10/1916 | Murray | 294/55 X |
| 2,047,485 | 7/1936 | McBrady | 294/57 |
| 3,345,670 | 10/1967 | Charie | 294/1.3 X |
| 3,676,887 | 7/1972 | Klein | 294/1.3 |
| 3,813,121 | 5/1974 | Marvin | 294/1.3 |
| 3,850,467 | 11/1974 | Johnson | 294/1.3 |
| 3,978,540 | 9/1976 | Peck et al. | 294/1.3 |
| 4,067,107 | 1/1978 | Scafetta | 294/55 X |
| 4,103,952 | 8/1978 | Thompson | 294/1.3 |
| 4,138,153 | 2/1979 | Brown | 294/1.3 |
| 4,215,886 | 8/1980 | Naderi et al. | 294/1.3 |
| 4,230,354 | 10/1980 | Claras | 294/1.3 |
| 4,252,356 | 2/1981 | Tokuzumi | 294/1.3 |
| 4,428,610 | 1/1984 | Guffey | 294/1.3 |
| 4,677,697 | 7/1987 | Hayes | 294/1.3 X |
| 4,718,707 | 1/1988 | Greenhut | 294/1.4 |
| 4,741,565 | 5/1988 | Bagg | 294/1.3 |
| 4,752,093 | 6/1988 | Haber et al. | 294/1.3 |
| 4,768,818 | 9/1988 | Kolic | 294/1.3 |
| 4,830,419 | 5/1989 | Watanabe | 294/1.3 |
| 4,854,624 | 8/1989 | Baymiller | 294/1.3 |

FOREIGN PATENT DOCUMENTS

| | | | |
|---|---|---|---|
| 567151 | 12/1932 | Fed. Rep. of Germany | 294/50 |
| 667608 | 11/1938 | Fed. Rep. of Germany | 294/57 |
| 2426772 | 1/1980 | France | 294/1.4 |
| 2556560 | 6/1985 | France | 294/1.3 |

*Primary Examiner*—Johnny D. Cherry

*Attorney, Agent, or Firm*—Kelly, Bauersfeld & Lowry

[57] ABSTRACT

A disposable animal litter collection device includes a rigid shovel blade and a shovel handle which extends through the rear edge of the shovel blade and is extendable between a first position and a second position. In the first position, the handle is stored generally adjacent to the shovel blade, and in the second position the handle extends rearwardly from the shovel blade. A collection bag is fixed to the rear edge of the shovel blade in a manner shielding a user's hand when grasping the handle from animal litter deposited on the shovel blade. This bag is capable of enclosing the shovel blade and any animal litter deposited thereon when the bag is extended over the shovel blade away from the handle to envelope the blade and any litter deposited thereon.

13 Claims, 1 Drawing Sheet

FIG. 1
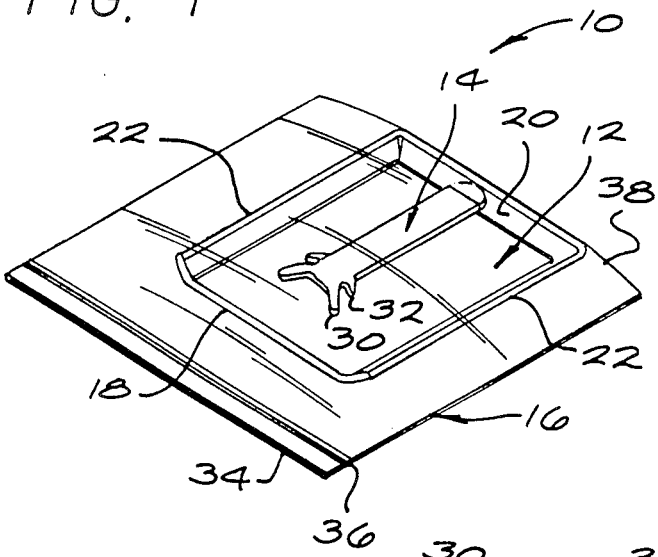
FIG. 3
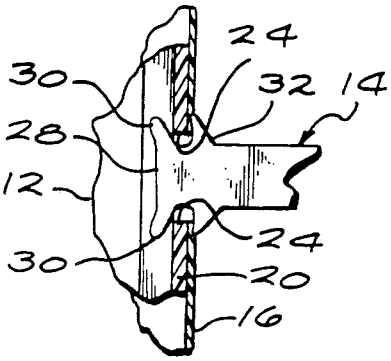
FIG. 2
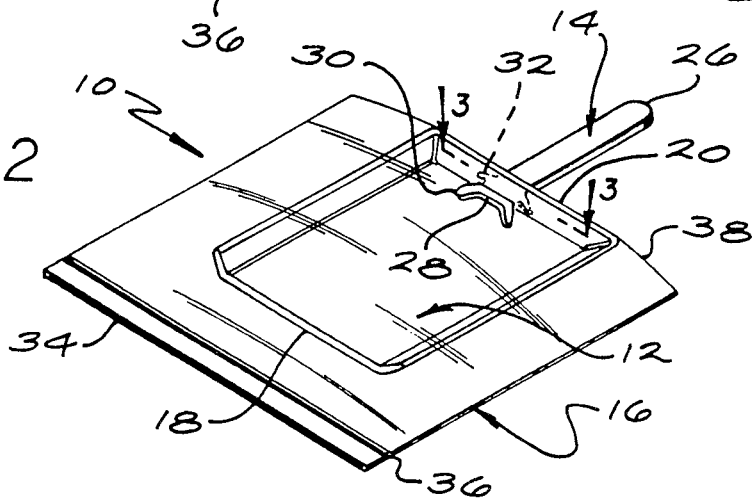
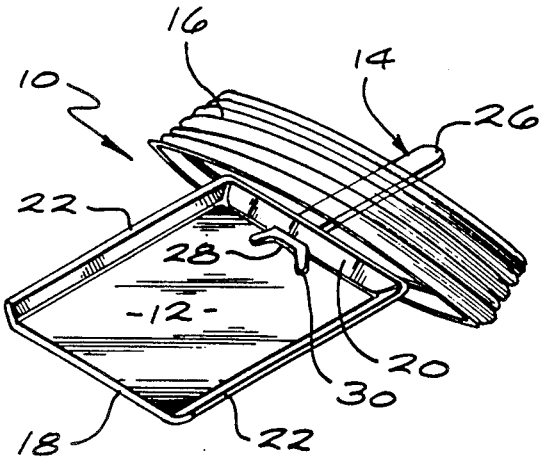
FIG. 4
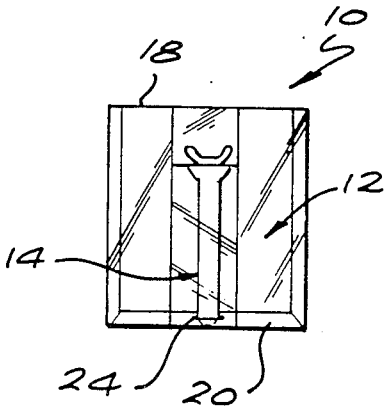
FIG. 5

DISPOSABLE COLLECTION DEVICE FOR ANIMAL LITTER

BACKGROUND OF THE INVENTION

This invention relates to containers for animal litter. More specifically, the present invention relates to disposable litter shovels having means for collecting and storing the animal litter until a proper disposal site can be found.

The rapid increase of urban populations coupled with the increasing popularity of dogs and other pets has created a serious sanitary problem in connection with the disposal of animal litter, and particularly canine litter. Concern results both from aesthetic considerations and from the potential for transmission of disease. Because many animal pet owners have permitted their animals to deposit solid excrement on both private and public property, a number of communities have enacted ordinances requiring pet owners, under penalty of fine, to retrieve and dispose of litter created by their pets.

It has been found that the generally willingness of pet owners to retrieve and properly dispose of animal litter is related to the ease, convenience and economy with which the litter may be handled in a clean and sanitary manner. While a number of articles and devices have been proposed for the purpose of disposing of animal litter, they have suffered from various shortcomings. Some devices have been provided which are not completely disposable, and, therefore, require some degree of cleanup. Other types of devices, both of the disposable and reusable varieties, sometimes fail to be completely sanitary, permitting or being susceptible of contact of the litter with the hands or clothing. Still others are awkward and conspicuous to carry, or require two hands to collect the litter. Moreover, many of the prior animal litter collection devices are either too expensive or distasteful to use.

Accordingly, there has been a need for a novel disposable collection device for animal litter which is inexpensive, lightweight and compact. Such a novel collection device would preferably fit easily within the pocket of a pet owner, for easy retrieval as needed. Additionally, there exists a need for such a collection device for animal litter which assures that the user will not come into contact with the litter under any circumstances, and which provides means for sealing the litter within a bag or the like until the collection device can be properly disposed of. Further, a novel disposable collection device for animal litter is needed which provides a rigid collection member to help facilitate the collection of certain types of animal excrement, and which may be used with one hand only. The present invention fulfills these needs and provides other related advantages.

SUMMARY OF THE INVENTION

The present invention resides in a disposable collection device for animal litter which is inexpensive, lightweight and compact so that it can fit into the pocket of a pet owner. The collection device comprises, generally, rigid shovel means for scooping and depositing animal litter thereon, a handle for the shovel means, and means for shielding a user of the collection device from animal litter deposited on the shovel means.

In a preferred form of the invention, the rigid shovel means comprises a shovel blade having a front edge, a rear edge and a pair of opposite side edges which extend between the front and rear edges. The side and rear edges are upturned to form a scoop-like structure for retaining animal litter deposited onto the shovel blade. Further, the rear edge provides an aperture through which the handle may be extended.

The handle is extendable between a first storage position and a second use position. In the first position, the handle is stored generally adjacent to the shovel blade. In the second position, the handle extends outwardly from the shovel blade through the aperture in the rear edge to provide convenient means for manipulating the shovel blade.

The shovel handle includes a first end positioned just rearwardly of the rear edge of the shovel blade when the handle lies in its first position. The first end of the handle may be grasped and pulled rearwardly to place the shovel handle in its second position. The shovel handle further includes a second end which is opposite the first end and includes means for firmly connecting the second end of the handle to the rear edge of the shovel blade. The connecting means includes an enlarged stop flange which is formed at the second end of the shovel handle, and a resilient stud which is spaced from the stop flange a distance which approximately corresponds with the cross-sectional width of the rear edge of the shovel blade. As the handle is extended rearwardly, the resilient stud deflects inwardly to pass through the aperture in the rear edge of the shovel blade, and then flexes outwardly to capture the rear edge of the shovel blade between the stop flange and the resilient stud.

The shielding means includes a large flexible bag, preferably constructed of a synthetic plastic opaque material, which bag is capable of shielding a user's hand grasping the handle from animal litter deposited on the shovel blade. The bag is fixed to the rear edge of the shovel blade, and may be withdrawn from around the shovel blade as animal litter is deposited thereon. Subsequently, the bag may be pulled over the shovel blade to envelope the blade and any animal litter deposited thereon. Means are provided for sealing an open end of the bag by means of a ziplock-type fastener to fully enclose the shovel blade and any litter deposited thereon. The collection device and the fully enveloped litter can then be conveniently transported and disposed of properly.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a top perspective view of a disposable collection device for animal litter embodying the invention, illustrating a flexible bag containing therein a rigid shovel blade and a handle;

FIG. 2 is a perspective view of the collection device similar to FIG. 1, illustrating the manner in which the handle can be extended through the bag and the shovel blade to a locked position;

FIG. 3 is an enlarged, fragmented and partially sectional view taken generally along the line 3—3 of FIG. 2, illustrating the manner in which a forward edge of the handle engages a rear edge of the shovel blade;

FIG. 4 is a perspective view of the collection device similar to FIGS. 1 and 2, illustrating the manner in which the bag may be retracted away from the shovel blade to provide a shield for a user's hand grasping the handle; and FIG. 5 is a top plan view of the collection device shown in FIG. 1, illustrating the manner in which the collection device can be provided to consumers wherein the bag is tightly folded about the shovel blade.

DETAILED DESCRIPTION OF THE PREFERRED EMBODIMENT

As shown in the drawings for purposes of illustration, the present invention is concerned with a disposable collection device for animal litter, generally designated in the accompanying drawings by the reference number 10. The collection device of the present invention is designed to be small enough to fit into the pocket of a pet owner, inexpensive, and easy to use so that animal litter can be tastefully collected and disposed of, even where no convenient disposal location exists.

In accordance with the present invention, and as illustrated in FIGS. 1 through 5, the collection device 10 comprises, generally, a shovel blade 12, a handle 14 for the shovel blade, and a flexible collection bag 16 which is large enough to fully envelope the shovel blade and any litter deposited thereon.

The shovel blade 12 includes a front edge 18, a rear edge 20, and a pair of opposite side edges 22 which extend between the front and rear edges. The rear edge 20 includes a slot-like aperture 24 through which the handle 14 may be extended. The side and rear edges 22 and 20 are upturned to form a scoop-like structure for retaining animal litter deposited onto the shovel blade 12.

As shown best in FIGS. 1 and 2, the shovel handle 14 is extendable between a first storage position and a second use position. In the first position (FIGS. 1 and 5), the handle 14 is stored generally adjacent to the shovel blade 12. In the second position (FIGS. 2 through 4), the handle 14 extends outwardly from the rear edge 20 of the shovel blade 12 to provide convenient means for manipulating the shovel blade. The handle 14 includes a first end 26 which, in the first position, is positioned just rearwardly of the rear edge 20 of the shovel blade 12. This permits the first end 26 to be grasped and pulled rearwardly to place the handle 14 in its second position. The handle 14 further includes a second end 28 which provides means for firmly connecting the second end of the handle 14 to the rear edge 20 of the shovel blade 12.

More particularly, the connecting means provided on the second end 28 includes a pair of enlarged stop flanges 30. Equidistantly spaced from the stop flanges 30 are a pair of resilient studs 32. The space between the stop flanges 30 and the studs 32 approximately corresponds with the cross-sectional width of the rear edge 20 of the shovel blade 12, such that a portion of the rear edge of the shovel blade can be captured between the stop flanges and the resilient studs.

As the handle 14 is extended rearwardly through the aperture 24 and the rear edge 20, the resilient studs 32 flex inwardly in order to pass through the aperture 24. Once they have passed through the aperture 24, the studs 32 resiliently flex outwardly and engage an outer surface of the rear edge 20 and an adjacent portion of the collection bag 16. As illustrated best in FIG. 3, those portions of the collection bag 16 and the rear edge 20 of the shovel blade 12 surrounding the aperture 24 are captured between the stop flanges 30 and the resilient studs 32. This provides a sturdy, rigid connection between the handle 14 and the shovel blade 12, thus enabling the user to solely grasp the handle 14 when manipulating the shovel blade 12 to pick-up animal litter.

The collection bag 16 comprises two sheets of flexible material heat-sealed to one another to form an enclosure. The forward end 34 of the collection bag 16 is openable, and is provided with a ziplock-type fastener 36 which is normally not sealed, but which may be in order to fully enclose the shovel blade 12 and any animal litter deposited thereon. A rearward end 38 of the bag 16 is preferably heat-sealed to the rear edge 20 of the shovel blade 12 and includes an aperture aligned with the aperture 24.

The collection bag 16 is capable of shielding a user's hand, while grasping the handle, from animal litter deposited on the shovel blade 12 when the bag is retracted away from the shovel blade (FIG. 4). After animal litter is deposited onto the shovel blade 12, the bag is capable of enclosing the shovel blade and any animal litter deposited thereon.

Although in the accompanying drawings the collection bag 16 is illustrated as being transparent, it is preferred that the bag be constructed of an opaque synthetic plastic material so that after the animal litter is collected, it is hidden from view. Moreover, it is presently preferred that the shovel blade 12 and handle 14 be constructed of a lightweight, inexpensive synthetic plastic material which provides sufficient rigidity for collecting most types of animal litter from a ground surface. It is possible, however, to manufacture the shovel blade 12 and the handle 14 from a rigid cardboard material, and similarly fabricate the collection bag 16 from a suitable paper material.

When the collection device 10 is initially manufactured, the bag 16 is heat-sealed to the rear edge 20 of the shovel blade 12, the handle 14 is placed in its first position to substantially overlie a portion of the shovel blade and so that the first end 26 thereof extends just barely through the aperture 24, and then the portions of the collection bag 16 which extend beyond the edges of the blade 12 are folded so that the maximum dimensions of the finished collection device 10 correspond generally with the overall dimensions of the shovel blade 12. An example of this configuration is illustrated in FIG. 5. A pet owner can then conveniently place one or more of these folded collection devices in a pocket when taking a pet on a walk, for use as needed.

After the owner's pet defecates, the owner simply removes the collection device 10 from his or her pocket, unfolds the collection bag 16 as shown in FIG. 1, grasps the first end 26 of the handle 14 and extends it rearwardly (FIG. 2), and insures that the rear edge 20 of the shovel blade 12 surrounding the aperture 24 is securely captured between the stop flanges 30 and the studs 32. Next, the collection bag 16 is retracted away from the shovel blade 12 to permit the pet owner to scoop the animal litter onto the shovel blade. The collection bag 16 in this configuration (FIG. 4) acts as a shield between the user's hand which is grasping the handle 14, and any litter on the shovel blade. After the animal litter is deposited onto the shovel blade 12, the collection bag is then placed over the shovel blade and the animal litter to envelope the blade and the litter, and then the fastener 36 is sealed to fully enclose the animal litter within the collection bag 16. The collection device 10 thus provides a convenient apparatus for safely and tastefully carrying the animal litter from the collection site to a proper disposal site.

From the foregoing it is to be appreciated that the disposable collection device for animal litter 10 is inherently inexpensive, lightweight and desirably compact. Animal litter can be collected utilizing only one hand of the pet owner, which permits the animal to be restrained on a leash with the other. Since the collection device 10 is disposable, there is no problem with having to clean the device after use. Further, the manner in which the collection bag retracts away from the shovel blade 12 and is disposed between the user's hand and the shovel blade advantageously provides a shield, at all times, between the pet owner and the animal litter. After the animal litter is collected upon the shovel blade 12, the collection bag can be quickly and conveniently enveloped about both the shovel blade and the animal litter to provide a safe and sanitary means for transporting and disposing of the animal litter.

Although a particular embodiment of the invention has been described in detail for purposes of illustration, various modifications may be made without departing from the spirit and scope of the invention. Accordingly, the invention is not to be limited, except as by the appended claims.

I claim:

1. A disposable collection device for animal litter, comprising:

a shovel blade having a front edge and a rear edge;

a shovel handle extending through and supported by the rear edge of the shovel blade, wherein the shovel handle is movable between a first position wherein it substantially overlies a portion of the shovel blade, and a second position wherein it firmly engages the rear edge of the shovel blade and extends rearwardly therefrom, the shovel handle including a first end positioned just rearwardly of the rear edge of the shovel blade when the shovel handle lies in its first position, such that the first end of the shovel handle may be grasped and pulled rearwardly to place the shovel handle in its second position, and wherein the shovel handle further includes a second end opposite the first end, which second end includes means for firmly connecting the second end of the shovel handle to the rear edge of the shovel blade, wherein the connecting means includes an enlarged stop flange formed at the second end of the shovel handle, and a resilient stud spaced from the stop flange a distance which approximately corresponds with the cross-sectional width of the rear edge of the shovel blade, such that a portion of the rear edge of the shovel blade can be captured between the stop flange and the resilient stud; and a collection bag fixed to the rear edge of the shovel blade, wherein the collection bag may be withdrawn from around the shovel blade as animal litter is deposited thereon, and subsequently pulled over the shovel blade to envelope the shovel blade and any animal litter deposited thereon.

2. An animal litter collection device as set forth in claim 1, wherein the shovel blade includes a pair of opposite side edges extending between the front and rear edges, wherein the side and rear edges are upturned to form a scoop-like structure for retaining animal litter deposited onto the shovel blade.

3. An animal litter collection device as set forth in claim 1, wherein the rear edge of the shovel blade includes an aperture through which the shovel handle slides.

4. An animal litter collection device as set forth in claim 1, wherein the collection bag is heat-sealed to the rear edge of the shovel blade and includes an aperture through which the shovel handle slides.

5. An animal litter collection device as set forth in claim 4, wherein the collection bag includes means for sealing an open end thereof to fully enclose the shovel blade and any litter deposited thereon.

6. An animal litter collection device as set forth in claim 5, wherein the sealing means comprises a ziplock-type fastener.

7. A disposable collection device for animal litter, comprising:

a rigid scoop-like blade having a front edge, a rear edge and a pair of opposite side edges extending between the front and rear edges, wherein the side and rear edges are upturned to form a scoop-like structure for retaining animal litter deposited onto the blade, wherein the rear edge further includes an aperture;

a rigid handle extending through and supported by the rear edge of the blade, wherein the handle is movable between a first position wherein it lies substantially adjacent to the blade, and a second position wherein it substantially extends rearwardly from the blade, wherein the handle includes a first end positioned just rearwardly of the rear edge of the blade when the handle lies in its first position, such that the first end of the handle may be grasped and pulled rearwardly to place the handle in its second position, and further including a second end opposite the first end, which second end includes means for firmly connecting the second end of the handle to the rear edge of the blade, wherein the connecting means includes an enlarged stop flange formed at the second end of the handle, and a resilient stud spaced from the stop flange a distance which approximately corresponds with the cross-sectional width of the rear edge of the blade, such that the portion of the rear edge of the blade surrounding the aperture therethrough can be captured between the stop flange and the resilient stud; and means for shielding a user of the collection device from animal litter deposited on the blade, wherein the shielding means includes a large flexible bag capable of shielding a user's hand grasping the handle from animal litter deposited on the blade when the bag is retracted away from the blade, and further being capable of enclosing the blade and any animal litter deposited thereon when the bag is extended over the blade and away from the handle, wherein the bag is heat-sealed to the rear edge of the blade and includes an aperture through which the handle slides, the bag including means for sealing an open end thereof when placed to envelope the blade and the contents thereof.

8. A disposable collection device for animal litter, comprising:

rigid shovel means for scooping and depositing animal litter thereon, the shovel means including a blade having a front edge, a rear edge and a pair of opposite side edges extending between the front and rear edges, wherein the side and rear edges are upturned to form a scoop-like structure for retaining animal liter deposited onto the shovel means, and wherein the rear edge of the shovel means includes an aperture through which a handle slides;

a handle for the shovel means, the handle being extendable between a first position wherein it is stored generally adjacent to the shovel means, and a second position wherein it extends outwardly from the shovel means to provide convenient means for manipulating the shovel means, the handle including a first end positioned just rearwardly of the rear edge of the shovel means when the handle lies in its first position, such that the first end of the handle may be grasped and pulled rearwardly to place the handle in its second position, and wherein the handle further includes a second end opposite the first end, which second end includes means for firmly connecting the second end of the handle to the rear edge of the shovel means, wherein the connecting means includes an enlarged stop flange formed at the second end of the handle, and a resilient stud spaced from the stop flange a distance which approximately corresponds with the cross-sectional width of the rear edge of the shovel means, such that a portion of the rear edge of the shovel means can be captured between the stop flange and the resilient stud; and means for shielding a user of the collection device from animal litter deposited on the shovel means.

9. An animal litter collection device as set forth in claim 8, wherein the shielding means includes a large flexible bag capable of shielding a user's hand grasping the shovel handle from animal litter deposited on the shovel means when the bag is retracted away from the shovel means, and further being capable of enclosing the shovel means and any animal litter deposited thereon when the bag is extended over the shovel means and away from the handle.

10. An animal litter collection device as set forth in claim 9, wherein the flexible bag is heat-sealed to the rear edge of the shovel means and includes an aperture aligned with the aperture in the rear edge of the shovel means through which the handle slides.

11. An animal litter collection device as set forth in claim 10, wherein the bag includes means for sealing an open end thereof to fully enclose the shovel means and any litter deposited thereon, wherein the sealing means comprises a ziplock-type fastener.

12. An animal litter collection device as set forth in claim 9, wherein the bag is constructed of a synthetic plastic material and is opaque.

13. A disposable collection device for animal litter, comprising:

rigid shovel means for scooping and depositing animal litter thereon;

a handle for the shovel means, the handle being extendable between a first position wherein it is stored generally adjacent to the shovel means, and a second position wherein it extends outwardly from the shovel means to provide convenient means for manipulating the shovel means, the handle including a first end positioned just rearwardly of a rear edge of the shovel means when the handle lies in its first position, such that the first end of the handle may be grasped and pulled rearwardly to place the handle in its second position, and wherein the handle further includes a second end opposite the first end, which second end includes means for firmly connecting the second end of the handle to the rear edge of the shovel means, wherein the connecting means includes an enlarged stop flange formed at the second end of the handle, and a resilient stud spaced from the stop flange a distance which approximately corresponds with the cross-sectional width of the rear edge of the shovel means, such that a portion of the rear edge of the shovel means can be captured between the stop flange and the resilient stud; and means for shielding a user of the collection device from animal litter deposited on the shovel means.

* * * * *